US006924590B2

(12) United States Patent
Tagami et al.

(10) Patent No.: US 6,924,590 B2
(45) Date of Patent: Aug. 2, 2005

(54) COLOR PICTURE TUBE DEVICE WITH DISTORTION CORRECTION COILS

(75) Inventors: Etsuji Tagami, Takatsuki (JP); Hiroshi Sakurai, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 139 days.

(21) Appl. No.: 10/366,897

(22) Filed: Feb. 14, 2003

(65) Prior Publication Data

US 2003/0173889 A1 Sep. 18, 2003

(30) Foreign Application Priority Data

Feb. 21, 2002 (JP) ..... 2002-045281

(51) Int. Cl.[7] ..... H01J 29/51; H01J 29/70

(52) U.S. Cl. ..... 313/440; 313/441; 313/442; 313/443; 313/431; 313/433; 313/412; 315/368.27; 315/368.28; 315/364; 315/370; 335/210; 335/213; 335/214

(58) Field of Search ..... 313/440, 441, 313/442, 430, 421, 428; 220/2.1 A, 2.1 R; 335/210–214

(56) References Cited

U.S. PATENT DOCUMENTS 4,618,843 A * 10/1986 Nakamura ..... 335/210
5,598,055 A 1/1997 Inoue et al. ..... 313/440
5,838,099 A * 11/1998 Hichiwa et al. ..... 313/440
5,847,503 A 12/1998 Roussel et al. ..... 313/440
6,326,742 B1 * 12/2001 Iwasaki et al. ..... 315/370
6,861,793 B2 * 3/2005 Sakurai et al. ..... 313/442

FOREIGN PATENT DOCUMENTS

JP 2001035415 A * 2/2001 ..... H01J/29/76
WO WO 00/28570 5/2000 ..... H01J/29/76

* cited by examiner

*Primary Examiner*—Joseph Williams
*Assistant Examiner*—Sikha Roy

(57) ABSTRACT

A color picture tube device has a funnel glass, a pair of horizontal deflection coils, an insulating frame, and a pair of vertical deflection coils. The pair of horizontal deflection coils are opposed to each other in a vertical direction around the outer surface of the funnel glass, and each have a window at the center. The insulating frame covers the horizontal deflection coils, resembles in shape a part of the funnel glass where the horizontal deflection coils are provided, and has openings in areas corresponding to windows of the horizontal deflection coils. The pair of vertical deflection coils are opposed to each other in a horizontal direction around the outer surface of the insulating frame, without overlapping the openings. A pair of correction coils are provided so as to be each at least partially inserted in a different one of the openings.

15 Claims, 12 Drawing Sheets

COLOR PICTURE TUBE DEVICE WITH DISTORTION CORRECTION COILS

This application is based on an application No. 2002-45281 filed in Japan, the contents of which are hereby incorporated by reference.

BACKGROUND OF THE INVENTION

1. Field of the Invention

The present invention relates to a color picture tube device used in televisions and the like, and in particular relates to techniques of correcting raster distortion.

2. Related Art

One type of raster distortion is called inner distortion. Inner distortion includes upper and lower inner pincushion distortion and upper and lower inner barrel distortion. The upper and lower inner pincushion distortion refers to a situation where the vertical amplitude of the electron beams inside the raster becomes insufficient in a direction toward the horizontal center of the screen. The upper and lower inner barrel distortion refers to a situation where the vertical amplitude of the electron beams inside the raster becomes excessive in the direction toward the horizontal center of the screen.

Such inner distortion can be effectively corrected by providing a means of generating a correction magnetic field in a region where deflection magnetic fields are generated by a deflection yoke. For example, a technique of placing a pair of upper and lower permanent magnets in the gaps between the horizontal deflection coil and the picture tube is known to remedy the upper and lower inner barrel distortion (Published Unexamined Japanese Patent Application No. H06-283115).

However, permanent magnets have relatively wide variations in the amount of magnetization, due to manufacturing reasons. Therefore, even if the pair of upper and lower permanent magnets are provided, there is a possibility that they may deviate from a magnetic field intensity tolerance set at the time of designing the picture tube device. Since the pair of upper and lower permanent magnets are situated near an area where electron beams pass through, such variations in magnetic force acutely affect convergence. If the pair of upper and lower permanent magnets deviate from the magnetic field intensity tolerance, misconvergence occurs which constitutes a significant problem for the use of the picture tube device.

This problem may be solved by employing coils that can deliver a desired magnetic field intensity more easily than permanent magnets. In general, however, a coil that delivers the same level of magnetic field intensity as a permanent magnet is larger in size than the permanent magnet. Accordingly, such a coil cannot be placed in a limited space between the horizontal deflection coil and the picture tube.

SUMMARY OF THE INVENTION

The present invention aims to provide a color picture tube device that can be equipped with coils for correcting inner distortion.

The stated object can be achieved by a color picture tube device including: a funnel glass; a pair of horizontal deflection coils which are opposed to each other in a vertical direction around an outer surface of the funnel glass, each horizontal deflection coil having a window at a center; an insulating frame which (a) covers the pair of horizontal deflection coils, (b) resembles in shape a part of the funnel glass where the pair of horizontal deflection coils are provided, and (c) has openings in areas corresponding to windows of the pair of horizontal deflection coils; a pair of vertical deflection coils which are opposed to each other in a horizontal direction around an outer surface of the insulating frame, without overlapping the openings; and a pair of correction coils which are each at least partially inserted in a different one of the openings.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENTS (First Embodiment)

The following describes the first embodiment of the present invention by referring to drawings.

Figure 1:
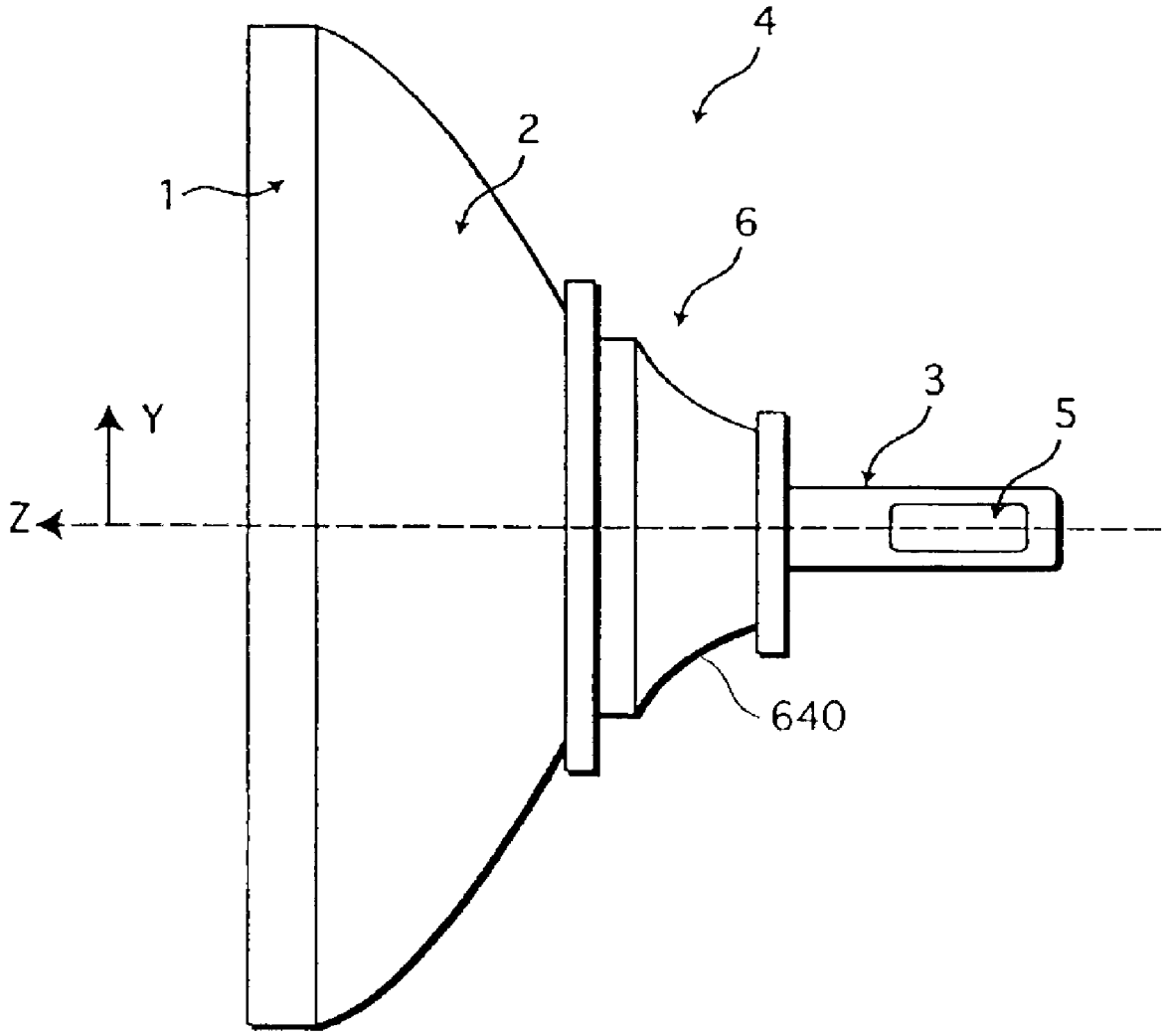
FIG. 1 shows a rough construction of a color picture tube device according to the first embodiment of the invention.

FIG. 1 shows a rough construction of a 32" flat-panel color picture tube device with a deflection angle of 120 degrees, to which the first embodiment relates.

This color picture tube device 4 is equipped with a front flat panel 1, a funnel glass 2, an in-line electron gun 5, and a deflection yoke 6. A phosphor screen is formed on the internal face of the flat panel 1. The in-line electron gun 5 is placed in a narrow cylindrical neck 3 of the funnel glass 2. The deflection yoke 6 is installed around the outside of the funnel glass 2. Here, the color picture tube 4 has an aspect ratio of 16:9. The in-line electron gun 5 is made up of three electron guns corresponding to the three colors of blue (B), green (G), and red (R), which are arranged in this order from left to right as seen from the phosphor screen side.

Three electron beams emitted from the in-line electron gun 5 in the direction of the tube axis of the color picture tube 4 are deflected by deflection magnetic fields generated in the deflection yoke 6, to scan the phosphor screen on the internal face of the flat panel 1.

Figure 2:
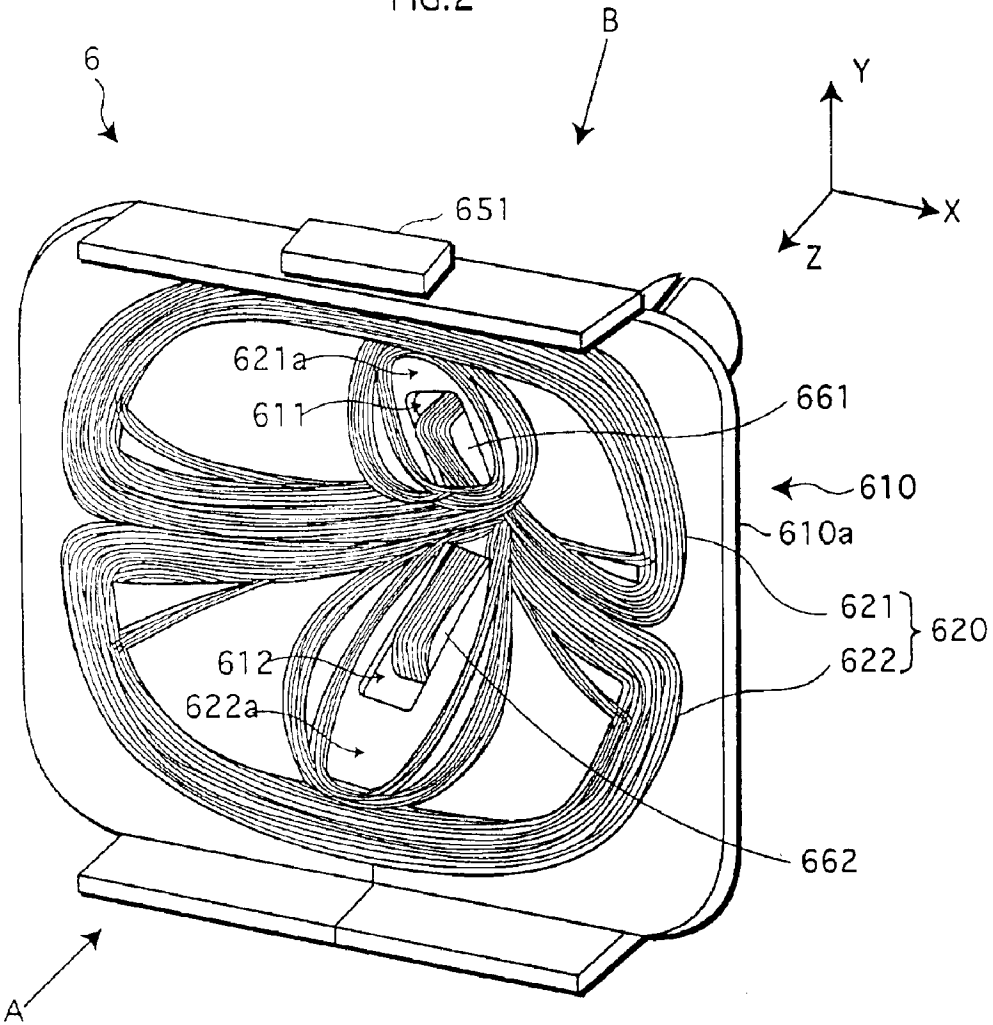
FIG. 2 is a perspective view showing a rough construction of a deflection yoke in the color picture tube device shown in FIG. 1.
Figure 3A:
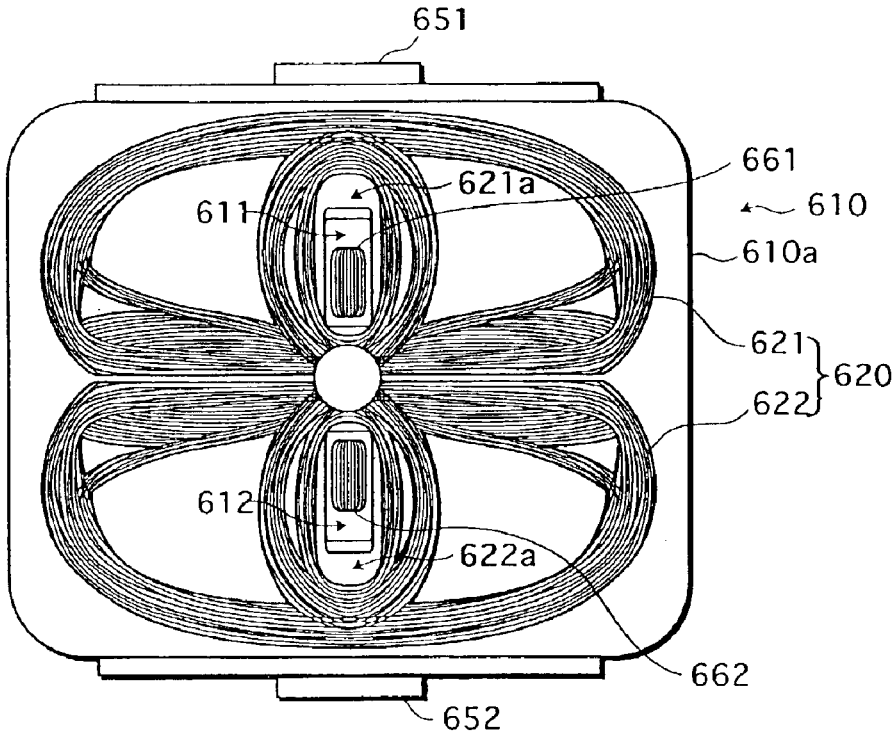
FIG. 3A shows the deflection yoke looked at from the direction of the arrow A in FIG. 2.
Figure 3B:
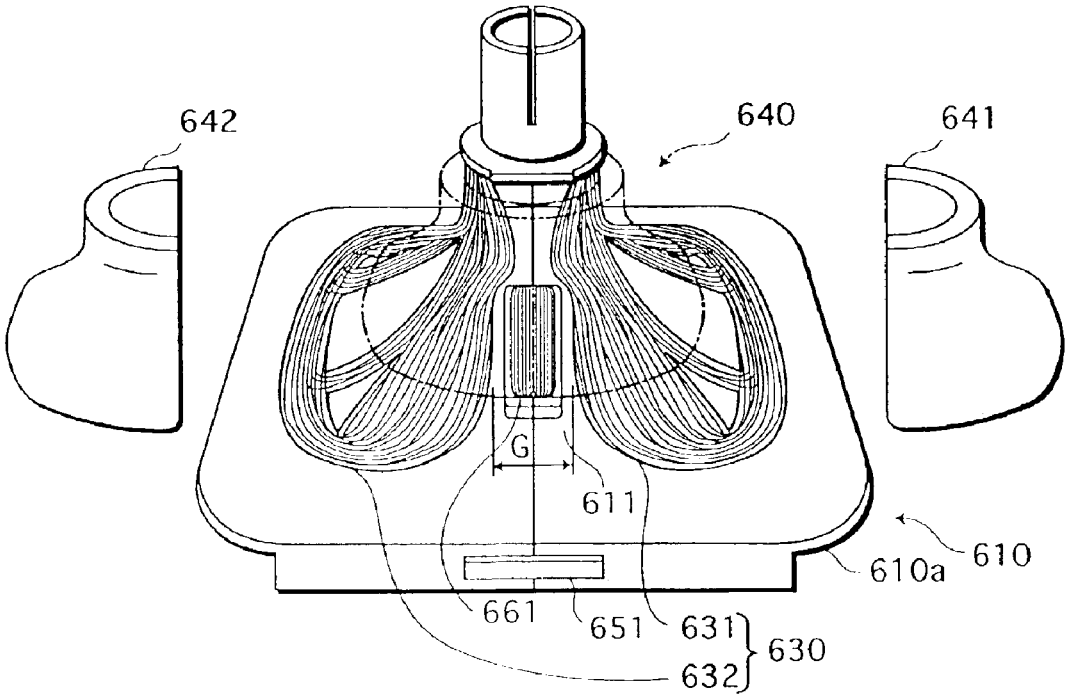
FIG. 3B shows the deflection yoke looked at from the direction of the arrow B in FIG. 2.

FIG. 2 is a perspective view showing a construction of the deflection yoke 6. FIG. 3A is a front view of the deflection yoke 6 looked at from the direction of the arrow A in FIG. 2. FIG. 3B is a perspective view of the deflection yoke 6 looked at from the direction of the arrow B in FIG. 2.

The following denotations are used in this embodiment. In an XYZ orthogonal coordinate system, the Z axis denotes the tube axis of the color picture tube 4, the X axis denotes the axis that is orthogonal to the Z axis on a horizontal plane containing the Z axis, and the Y axis denotes the axis that is orthogonal to the Z axis on a vertical plane containing the Z axis, as shown in FIGS. 1 and 2. Also, upper and lower halves are defined by the tube axis (Z axis) as a line of demarcation. Likewise, left and right halves are defined by the tube axis (Z axis) as a line of demarcation, when looking at the electron gun 5 from the phosphor screen side.

The deflection yoke 6 includes an insulating frame 610, a horizontal deflection coil 620, a vertical deflection coil 630, and a ferrite frame (ferrite core) 640. The insulating frame 610 has a funnel-shaped part resembling the shape of the part of the color picture tube 4 (funnel glass 2) where the deflection yoke 6 is provided. The horizontal deflection coil 620 is saddle-shaped and is placed around the inner surface of the insulating frame 610. The vertical deflection coil 630 is saddle-shaped and is placed around the outer surface of the insulating frame 610. The ferrite frame 640 is provided outside of the vertical deflection coil 630.

The horizontal deflection coil 620 is made up of one pair of horizontal deflection coils 621 and 622 which are opposed to each other with the horizontal plane (XZ plane) in between. Here, the horizontal deflection coils 621 and 622 are substantially symmetrical with respect to the horizontal plane.

The vertical deflection coil 630 is made up of one pair of vertical deflection coils 631 and 632 which are opposed to each other with the vertical plane (YZ plane) in between. Here, the vertical deflection coils 631 and 632 are substantially symmetrical with respect to the vertical plane.

The ferrite frame 640 is a tube having a conical shape. The ferrite frame 640 is placed outside of the vertical deflection coil 630, so as to cover the horizontal deflection coil 620 and the vertical deflection coil 630 except both ends of the deflection coils 620 and 630 in the direction of the tube axis. The ferrite frame 640 is made up of one pair of symmetrical semi-ring ferrite frame portions 641 and 642, and is positioned as designated by the dash lines in FIG. 3B.

The insulating frame 610 is an insulator (plastic molding) that has a substantially uniform overall thickness. The phosphor screen end of the aforementioned funnel-shaped part is shaped like a square. This square-shaped end of the insulating frame 610 is hereafter called a "frame 610*a*".

The deflection yoke 6 also has one pair of correction magnets on the upper and lower side faces of the frame 610*a* near the opening of the deflection yoke 6 on the phosphor screen side. The correction magnets are each a square-bar magnet having the shape of a parallelepiped (rectangular parallelepiped).

In detail, one pair of magnets 651 and 652 (hereafter referred to as an "upper magnet 651" and a "lower magnet 652") are formed at the center of the upper and lower side faces of the frame 610*a*, respectively.

Each of the upper magnet 651 and the lower magnet 652 is oriented so that the arranging direction of the north and south poles is in parallel with the horizontal axis (X axis). The upper magnet 651 has the north pole on the right and the south pole on the left. Meanwhile, the lower magnet 652 has the south pole on the right and the north pole on the left. Also, the upper magnet 651 and the lower magnet 652 are each situated such that both of the upper and lower surfaces are in parallel with the horizontal plane (XZ plane). A main purpose of providing such upper magnet 651 and lower magnet 652 is to correct upper and lower pincushion distortion. The upper and lower pincushion distortion occurs when the vertical amplitude of the electron beams becomes insufficient in a direction toward the horizontal center of the phosphor screen, on the periphery of the raster and in the inner areas of the raster near the periphery. The provision of such magnets is well-known in the art. Also, the principle of correcting upper and lower pincushion distortion by these magnets is the same as the principle of correcting upper and lower inner pincushion distortion by correction coils described later, so that its explanation has been omitted here.

The deflection yoke 6 also has one pair of solenoid coils 661 and 662 (hereafter referred to as "correction coils 661 and 662") which are opposed to each other with the horizontal plane (XZ plane) in between. The correction coils 661 and 662 each have a magnetic core. A main purpose of providing the correction coils 661 and 662 is to correct upper and lower inner pincushion distortion, though they also have a function of correcting some of upper and lower pincushion distortion.

Conventionally, permanent magnets (ferrite magnets) are used to correct upper and lower inner pincushion distortion. Such a permanent magnet has a thickness of 2 [mm], a width of 15 [mm], and a length of 20 [mm]. Also, the magnetic poles are arranged in the direction of the width (on the edges of the width).

Figure 4A:
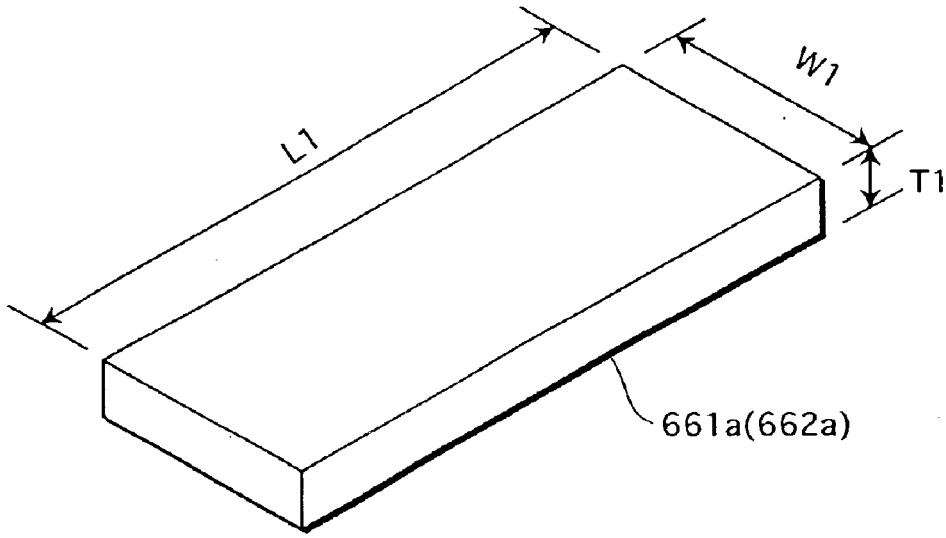
FIG. 4A is a perspective view showing a magnetic core of a correction coil shown in FIG. 2.
Figure 4B:
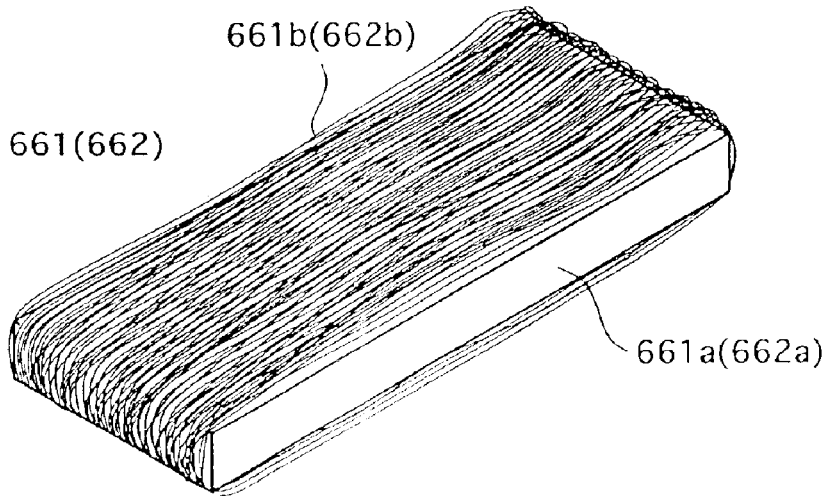
FIG. 4B is a perspective view of the correction coil.

To deliver the same level of magnetic flux density as these permanent magnets, each of the correction coils 661 and 662 has the following construction. A magnetic core 661*a* (662*a*) is made of ferrite and shaped like a rectangular parallelepiped with a thickness T1 of 4 [mm], a width W1 of 15 [mm], and a length L1 of 40 [mm], as shown in FIG. 4A. 100 turns of copper wire 661*b* (662*b*) with a diameter of $\phi$0.36 [mm] are wound on this magnetic core 661*a* (662*a*). Also, a current of 1.2 [A] needs to be supplied to each of the correction coils 661 and 662 (i.e. the magnetomotive force of the correction coils 661 and 662 is 120 [AT]). In this embodiment, power is supplied to the correction coils 661 and 662 from a direct-current power source. Also, the copper wire 661*b* (662*b*) is wound around the magnetic core 661*a* (662*a*) except both edges of the width as shown in FIG. 4B, so that the magnetic poles appear on the edges of the width. The thickness of each of the correction coils 661 and 662 is about 7 [mm].

The above permanent magnets can be placed in windows 621*a* and 622*a* (i.e. the gaps between the insulating frame 610 and the color picture tube 4) which are present respectively in the middle of the horizontal deflection coils 621 and 622. However, the correction coils 661 and 662 are larger in size than the permanent magnets, as noted above. Especially, the thickness of the correction coils 661 and 662 is much greater than that of the permanent magnets. Hence the correction coils 661 and 662 cannot be placed in the limited spaces formed by the windows 621*a* and 622*a*.

In this embodiment, openings 611 and 612 are formed in the parts of the insulating frame 610 that correspond to the windows 621*a* and 622*a* in the middle of the horizontal deflection coils 621 and 622, to create enough spaces for placing the correction coils 661 and 662. Also, a gap G is set between the vertical deflection coils 631 and 632, to keep the vertical deflection coils 631 and 632 from overlapping the openings 611 and 612. Which is to say, the vertical deflection coils 631 and 632 are wound so as not to overlap the openings 611 and 612. The gap G is typically (conventionally) about 6 [mm]. In this embodiment, however, the gap G is about 16 [mm] in the longest part (i.e. the gap G is extended to 16 [mm]). Though holes are bored through the insulating frame 610 to form the openings 611 and 612 in this embodiment, the invention is not limited to such. For example, parts of the insulating frame 610 may be cut away in the U shape, to form openings.

The correction coil 661 (662) is placed in the space which extends from the window 621*a* (622*a*) of the horizontal deflection coil 621 (622) through the opening 611 (612) of the insulating frame 610 to the gap between the vertical deflection coils 631 and 632. In other words, the correction coils 661 and 662 are partially inserted in the openings 611 and 612 respectively. Here, each of the correction coils 661 and 662 is set so as to extend along the sloping surface of the funnel glass 2. Also, the correction coil 661 is oriented so that the north pole appears on the right and the south pole appears on the left when supplied with power. Meanwhile, the correction coil 662 is oriented so that the south pole appears on the right and the north pole appears on the left when supplied with power.

This being so, if the spaces for placing the correction coils 661 and 662 are still insufficient, the inner surface of the ferrite frame 640 is partially recessed to form depressions (recesses), to enlarge the spaces for placing the correction coils 661 and 662. In this case, the correction coils 661 and 662 are partly inserted in these depressions, too.

Figure 5A:
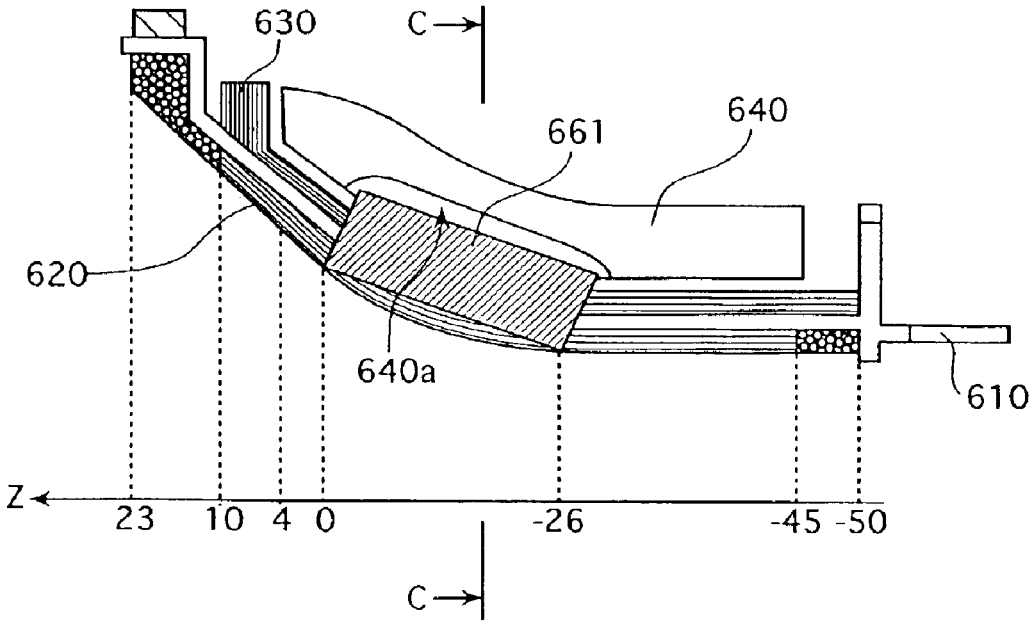
FIG. 5A is a longitudinal section of the upper half of the deflection yoke shown in FIG. 2.
Figure 5B:
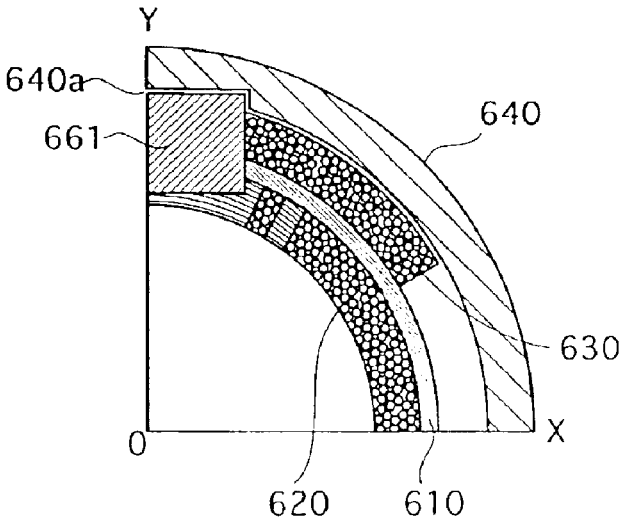
FIG. 5B is a cross section of the upper right portion of the deflection yoke, taken along the lines C—C in FIG. 5A.

FIG. 5A shows a longitudinal section of part of the deflection yoke 6 when a depression 640*a* is formed in the ferrite frame 640. FIG. 5B shows a cross section of part of the deflection yoke 6, taken along the lines C—C in FIG. 5A.

The position of each member of the deflection yoke 6 in the direction of the Z axis is the following. Here, the geometrical deflection center of the color picture tube 4 is set as the origin point of the Z axis. This being so, the horizontal deflection coil 620 is positioned at Z=−50 to 23 [mm], the vertical deflection coil 630 is positioned at Z=−50 to 10 [mm], the ferrite frame 640 is positioned at Z=−45 to 4 [mm], and the correction coil 661 (662) is positioned at Z=−26 to 0 [mm].

Figure 6A:
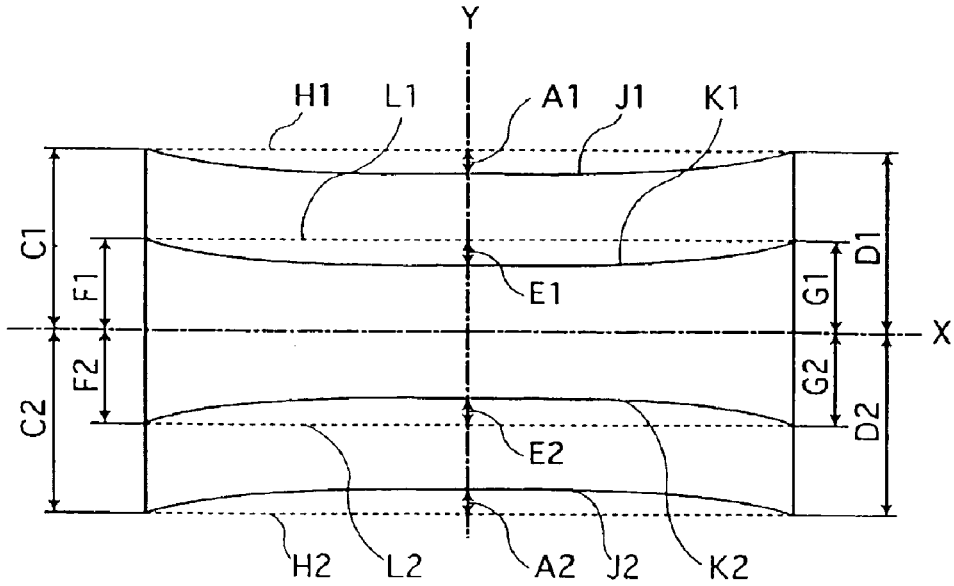
FIG. 6A shows upper and lower pincushion distortion and upper and lower inner pincushion distortion.
Figure 6B:
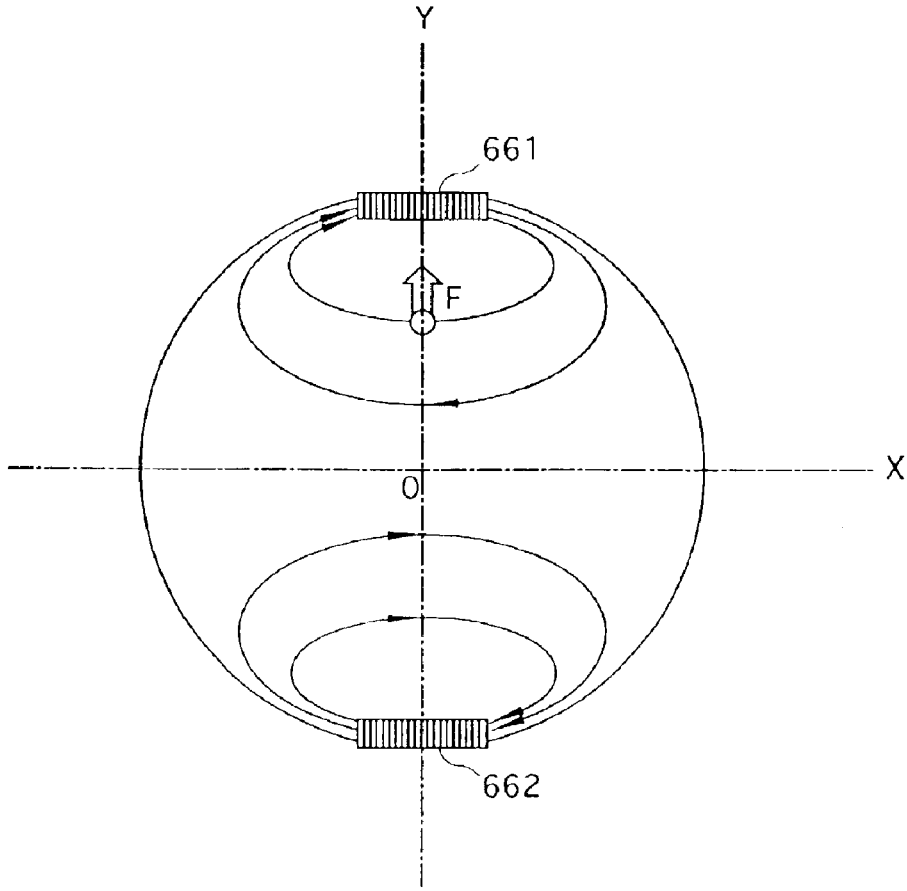
FIG. 6B gives a graphic representation of a principle of correcting upper and lower inner pincushion distortion using correction coils.

The principle of correcting upper and lower inner pincushion distortion by the above constructed correction coils 661 and 662 is explained below, with reference to FIG. 6. FIG. 6A shows an example of upper and lower inner pincushion distortion. FIG. 6B shows magnetic fields generated by the correction coils 661 and 662 on the XY plane in a region where the correction coils 661 and 662 are positioned.

Electron beams fly in the direction of the tube axis (Z axis). The correction coil 661 generates a leftward magnetic field that is orthogonal to the direction of the tube axis, in an area where the electron beams pass through. As a result, the electron beams are acted upon by Lorentz force F in an upward direction. Here, the correction coil 661 is situated inside the ferrite frame 640. Accordingly, the effect of the magnetic field generated by the correction coil 661 is greater in the center than in the periphery of the area where the electron beams pass through. Also, the correction coil 661 is situated substantially in the middle of the whole deflection yoke 6 in the direction of the X axis. Accordingly, the Lorentz force F is greater when the electron beams are directed more toward the horizontal center of the phosphor screen. Thus, the upper part of the upper and lower inner pincushion distortion is corrected.

The lower part of the upper and lower inner pincushion distortion is corrected by the correction coil 662, according to the same principle as the correction coil 661 (though the directions of the magnetic field and Lorentz force F are opposite to those of the correction coil 661). As a result, the whole upper and lower inner pincushion distortion is eliminated or suppressed.

The effects of the magnetic fields of the correction coils 661 and 662 also appear on or near the periphery of the area where the electron beams pass through. This allows the upper and lower pincushion distortion to be corrected too.

The following explains how to express the extent of upper and lower pincushion distortion and the extent of upper and lower inner pincushion distortion.

The extent of upper and lower pincushion distortion is expressed as follows.

In FIG. 6A, let C1 and D1 be the distances between the vertical center of the phosphor screen and the left and right ends of the top line J1 of the raster. Also, let A1 be the distance between the straight line H1 connecting the left and right ends and the line J1 on the vertical axis Y. This being the case, the extent TP [%] of upper distortion in the upper and lower pincushion distortion is expressed as $$TP=\{2A1/(C1+D1)\}\times 100$$

Likewise, the extent BP [%] of lower distortion in the upper and lower pincushion distortion is expressed as $$BP=\{2A2/(C2+D2)\}\times 100$$

Then the extent TBP [%] of the upper and lower pincushion distortion is $$TBP=(TP+BP)/2$$

The extent of upper and lower inner pincushion distortion can be evaluated in the same way as the above upper and lower pincushion distortion.

In more detail, let F1 and G1 be the distances between the vertical center of the phosphor screen and the left and right ends of the line K1 of the raster. Also, let E1 be the distance between the straight line L1 connecting the left and right ends and the line K1 on the vertical axis Y. This being so, the extent TPi [%] of upper distortion in the upper and lower inner pincushion distortion is $$TPi=\{2E1/(F1+G1)\}\times 100$$

Likewise, the extent BPi [%] of lower distortion in the upper and lower inner pincushion distortion is expressed as $$BPi=\{2E2/(F2+G2)\}\times 100$$

Then the extent TBPi [%] of the upper and lower inner pincushion distortion is $$TBPi=(TPi+BPi)/2$$

Suppose the correction coils 661 and 662 are not provided and only the upper magnet 651 and the lower magnet 652 are used to correct upper and lower pincushion distortion. In this case, upper and lower pincushion distortion of TBP=7.6[%] and upper and lower inner pincushion distortion of TBPi=4.3[%] occur. If the correction coils 661 and 662 are provided, on the other hand, the extent of upper and lower pincushion distortion is reduced to TBP=0.6[%] and the extent of upper and lower inner pincushion distortion is reduced to TBPi=0.3[%].

The same correction effect can be produced using permanent magnets. However, when the correction coils 661 and 662 are used, the occurrence of YH misconvergence can be suppressed too, unlike the case where permanent magnets are used.

Figure 7A:
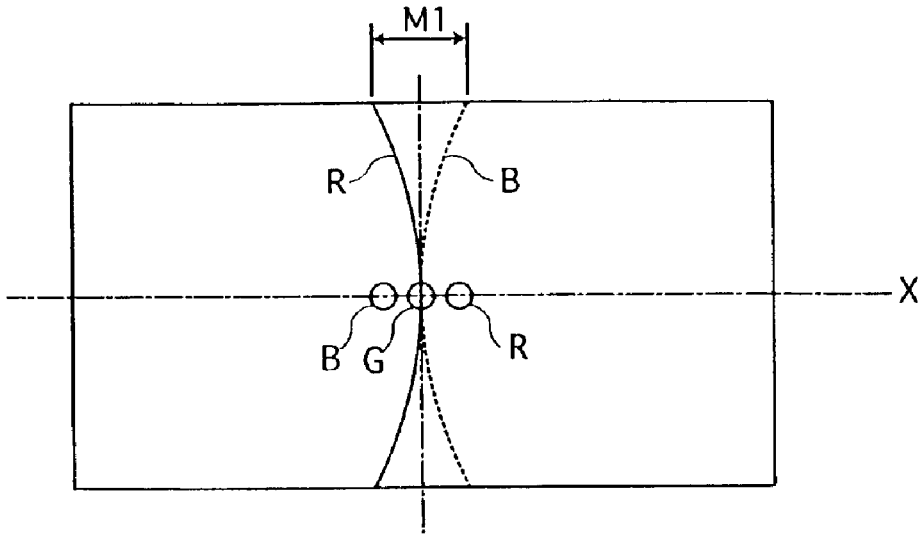
FIG. 7A shows an example of YH misconvergence.
Figure 7B:
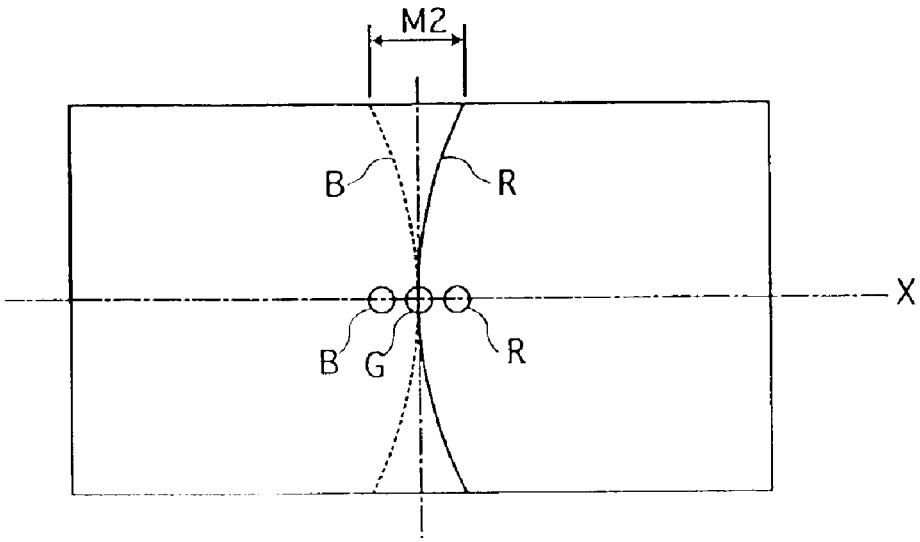
FIG. 7B shows another example of YH misconvergence.

YH misconvergence is the following. Three electron beams of blue (B), green (G), and red (R) do not meet each other at one point on the phosphor screen. Rather, the two outer electron beams (B and R) move away from each other on opposite sides of the central electron beam (G) in the horizontal direction, as they are directed more toward the upper and lower edges of the phosphor screen, as shown in FIGS. 7A and 7B.

Such YH misconvergence is caused by the excess or deficiency of the magnetic flux density of permanent magnets or correction coils. Though a more detailed explanation on the mechanism of the occurrence of YH misconvergence has been omitted here, YH misconvergence occurs roughly in the following fashions. If the magnetic flux density of the permanent magnets or correction coils exceeds a targeted value (set value), YH misconvergence occurs in such a fashion that the red electron beam deviates to the left whereas the blue electron beam deviates to the right, as shown in FIG. 7A. If the magnetic flux density is below the targeted value (set value), on the other hand, the red electron beam deviates to the right whereas the blue electron beam deviates to the left, as shown in FIG. 7B.

Here, let the extent of YH misconvergence be expressed by the horizontal distance between the red electron beam and the blue electron beam at the top of the raster. The horizontal distance is M1 in the case of FIG. 7A, and M2 in the case of FIG. 7B. This distance can be measured using a CCD camera.

Suppose M1 has a positive sign and M2 has a negative sign. Then the horizontal distance between the red electron beam and the blue electron beam has a normal distribution with a mean value of approximately 0. Let the standard deviation be denoted by $\sigma$. This being so, it has been confirmed that $3\sigma=0.43$ when permanent magnets are used whereas $3\sigma=0.31$ when correction coils are used. Thus, if correction coils are used, the standard deviation $\sigma$ ($3\sigma$) can be reduced by about 28% when compared with the case where permanent magnets are used.

This difference in dispersion (standard deviation) between when permanent magnets are used and when correction coils are used occurs for the following reason. As explained earlier, this dispersion correlates with the variation in magnetic flux density of permanent magnets or correction coils. Permanent magnets have variations in magnet flux density according to the amount of magnetization. Meanwhile, correction coils have variations in magnetic flux density mainly according to the winding regularity. In detail, the magnetic flux density varies by about 8% according to the amount of magnetization between permanent magnets, due to manufacturing reasons. Meanwhile, the magnetic flux density varies only by 4 to 5% according to the winding regularity between correction coils. This is because the precision of a coil winding machine which influences the winding regularity is typically very high.

As described above, according to this embodiment the correction coils 661 and 662 for correcting upper and lower inner pincushion distortion can be provided in or near the region where the deflection magnetic fields are generated by the horizontal deflection coil 620 and vertical deflection coil 630. As a result, the upper and lower inner pincushion distortion is corrected while at the same time the extent of YH misconvergence is reduced when compared with the case where permanent magnets are used.

In this embodiment, the openings 611 and 612 are formed in the insulating frame 610 to secure the spaces for placing the correction coils 661 and 662. Such a construction does not produce any adverse effect. The insulating frame 610 is intended to provide electrical isolation between the horizontal deflection coil 620 and the vertical deflection coil 630. This purpose can be served so long as the insulating frame 610 exists in the areas where the horizontal deflection coil 620 and the vertical deflection coil 630 face (overlap) each other.

In this embodiment, a gap larger than usual is set between the vertical deflection coils 631 and 632. Such a construction does not produce any adverse effect, either. This is because a magnetic field having the same effect as a magnetic field generated by part of the vertical deflection coils which should be present if the gap were not expanded can be generated by a correction coil placed in this extended gap.

Though the present invention has been described by way of the above embodiment, it should be obvious that the invention is not limited to the above. Example modifications are given below.

Figure 8:
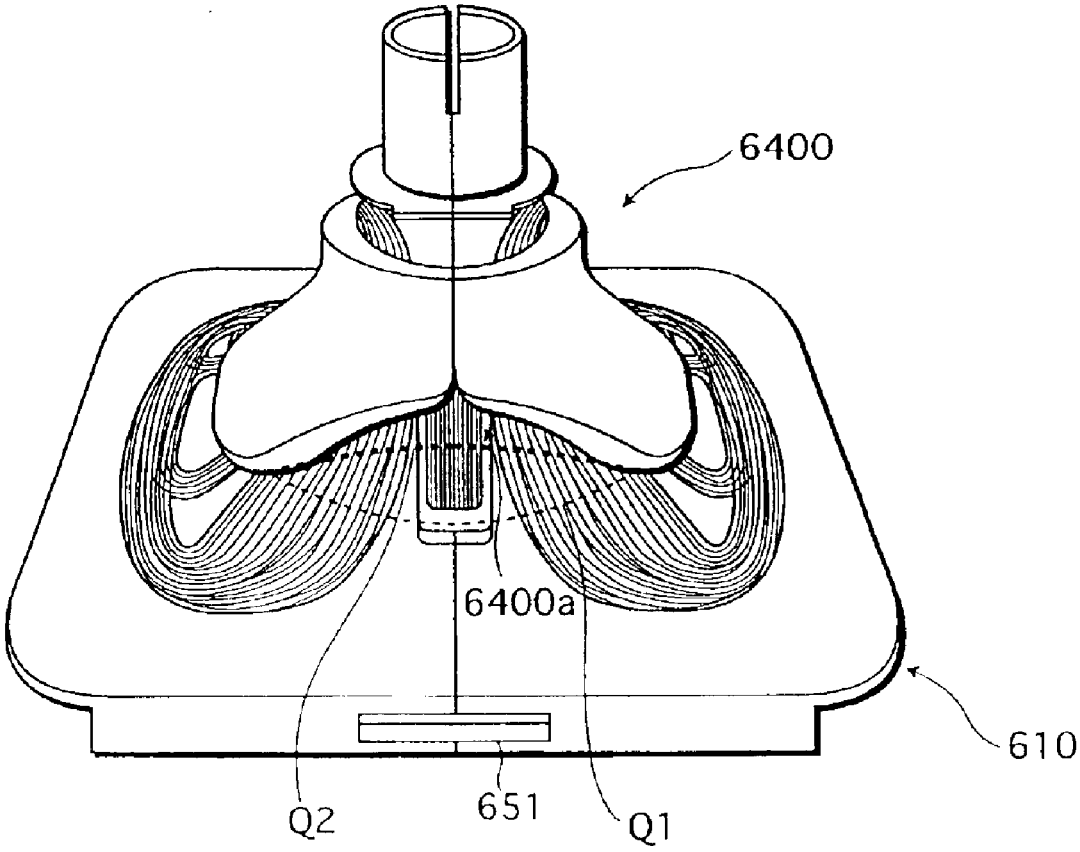
FIG. 8 is a perspective view showing a modification to the deflection yoke of the first embodiment.

(1) The above embodiment describes the case where the depressions are formed on the inner surface of the ferrite frame 640 to expand the spaces for placing the correction coils 661 and 662. As an alternative, part of the ferrite frame may be removed as shown in FIG. 8, to expand the spaces for placing the correction coils 661 and 662. In the drawing, a ferrite frame of the original shape designated by the thin broken line Q1 is partly cut away to create a ferrite frame 6400. Such a cut is made to the ferrite frame both above and below the horizontal plane (XZ plane), in the direction of the tube axis (Z axis). Note that the cut made below the horizontal plane is hidden by the deflection yoke 6 and so is not shown in the drawing. Furthermore, a depression 6400*a* is formed on the inner surface of the ferrite core 6400 whose original shape is designated by the thick broken line Q2.

Such a removal of part of the ferrite frame causes the distribution of the deflection magnetic fields to change. However, the original distribution can be recovered by changing the winding patterns of the horizontal deflection coil 620 and vertical deflection coil 630.

(2) The above embodiment describes the case where the magnetic core of each of the correction coils 661 and 662 is not magnetized. Instead, part of the magnetic core may be formed from a magnetized magnetic body, namely, a permanent magnet.

Figure 9A:
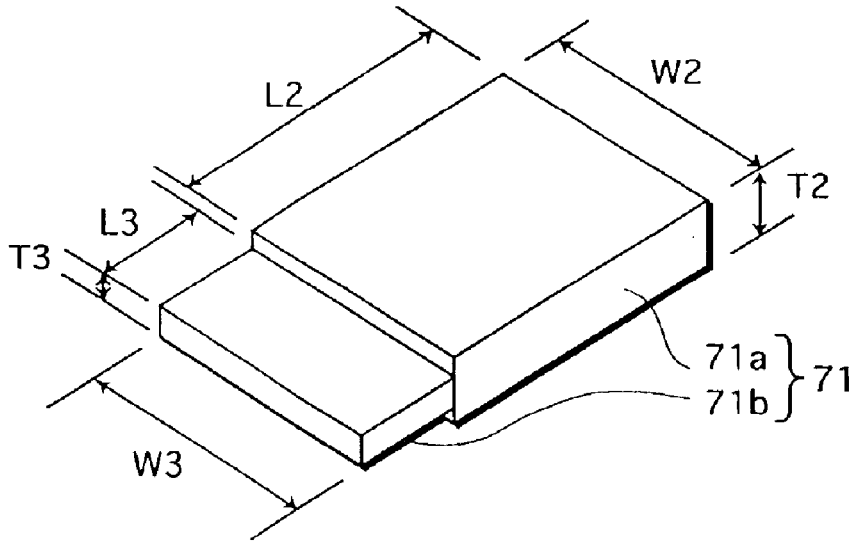
FIG. 9A is a perspective view showing a modification to the magnetic core of the correction coil in the first embodiment, where part of the magnetic core is a permanent magnet.
Figure 9B:
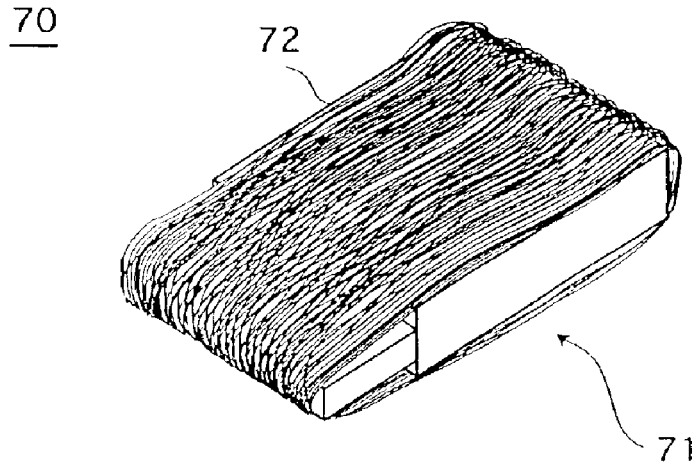
FIG. 9B is a perspective view showing the correction coil which has the magnetic core shown in FIG. 9A.

FIG. 9A is a perspective view of a magnetic core 71 according to this modification. As shown in the drawing, the magnetic core 71 is formed by bonding a permanent magnet 71*b* to a core 71*a* made of ferrite, using an adhesive (not illustrated). Here, the core 71*a* has a thickness T2 of 4 [mm], a width W2 of 15 [mm], and a length L2 of 20 [mm]. The permanent magnet 71*b* has a thickness T3 of 2 [mm], a width W3 of 15 [mm], and a length L3 of 5 [mm]. A copper wire 72 is wound on this magnetic core 71 as shown in FIG. 9B, thereby forming a correction coil 70. Which is to say, the correction coil 70 is made by replacing part of the magnetic core 661*a* (662*a*) of the correction coil 661 (662) shown in FIG. 4B with a permanent magnet. In other words, the magnetic core 661*a* (662*a*) is divided into a plurality of parts (two in this example) and one of them is formed from a permanent magnet. When the magnetomotive force of the correction coil 70 is 120 [AT], the correction coil 70 has the same effect of correcting upper and lower inner pincushion distortion and upper and lower pincushion distortion as the correction coil 661 (662).

The permanent magnet 71*b* is designed so that the magnetic poles appear on the edges of the width. In the opening 611, the correction coil 70 is oriented such that the north pole appears on the right and the south pole appears on the left. In the opening 612, on the other hand, the correction coil 70 is oriented such that the south pole appears on the right and the north pole appears on the left.

With regard to the direction of the tube axis (Z axis), the correction coil 70 is oriented such that the permanent magnet 71*b* is situated on either the electron gun side or on the phosphor screen side.

If the part of the magnetic core 661*a* (662*a*) that is replaced with a permanent magnet is excessively large, the aforedescribed problem concerning the dispersion of YH misconvergence arises due to variations in magnetic field density of permanent magnets. Accordingly, it is desirable to replace the part of the magnetic core 661*a* (662*a*) with a permanent magnet within a range where the dispersion of YH misconvergence can be tolerated.

By forming part of the magnetic core using a permanent magnet in this way, it is possible to reduce the size of the entire correction coil.

Here, the copper wire 72 is wound not only on the magnetic core 71*a* but also on the permanent magnet 71*b*, for the following reason. Since the cross-sectional area of the correction coil increases, a larger magnetic flux occurs, thereby increasing the magnetic flux density in a region where electron beams can be affected.

(3) The above embodiment describes the case where a coil having a magnetic core is used as each of the correction coils 661 and 662, but an air-core coil may instead be used.

Figure 10:
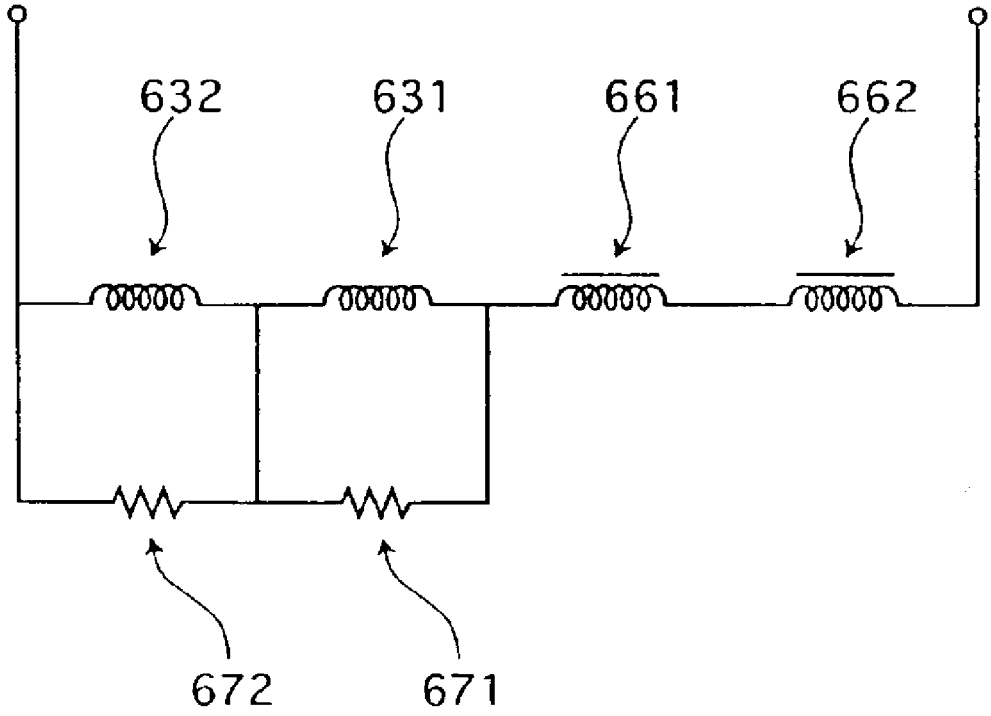
FIG. 10 shows an example of part of a vertical deflection circuit.

(4) The above embodiment describes the case where a direct current is supplied to each of the correction coils 661 and 662, but this is not a limit for the present invention. For example, the correction coils 661 and 662 may be connected in series with the vertical deflection coils 631 and 632, so that a vertical deflection current is supplied to the correction coils 661 and 662. FIG. 10 shows part of a vertical deflection circuit in this case. In the drawing, reference numerals 671 and 672 are damping resistors which are connected in parallel with the vertical deflection coils 631 and 632 respectively. Here, the correction coil 661 is wound so that the north pole appears on the right and the south pole appears on the left when the electron beams are directed toward the upper half of the phosphor screen. Meanwhile, the correction coil 662 is wound so that the south pole appears on the right and the north pole appears on the left when the electron beams are directed toward the lower half of the phosphor screen.

Also, the number of turns of the correction coil 661 is adjusted so that the same magnetic flux density as that of the correction coil 661 of the above embodiment is produced when the electron beams are directed toward the top of the phosphor screen. Likewise, the number of turns of the correction coil 662 is adjusted so that the same magnetic flux density as that of the correction coil 662 of the above embodiment is produced when the electron beams are directed toward the bottom of the phosphor screen. Since the correction coils 661 and 662 are intended to correct upper and lower inner pincushion distortion, it seems sufficient to produce the same magnetic flux density as that of the correction coils 661 and 662 of the above embodiment when the electron beams are directed toward the middle part of the phosphor screen (i.e. the lower half of the upper half of the phosphor screen and the upper half of the lower half of the phosphor screen) where inner pincushion distortion appears. However, this causes the top and bottom of the raster to exceed a tolerance and end up being seriously distorted.

(5) The above embodiment describes an example when the correction coils 661 and 662 are used to correct upper and lower inner pincushion distortion, but this is not a limit for the invention. For instance, correction coils may be used to correct upper and lower inner barrel distortion which is opposite to the upper and lower inner pincushion distortion. In such a case, the winding directions and current supply directions of the correction coils are set so as to reverse the magnetic poles of the correction coils 661 and 662 of the above embodiment.

(Second Embodiment)

The following describes the second embodiment of the present invention.

In this embodiment, the horizontal deflection magnetic field is made substantially uniform, to keep the electron beams from being deformed by the horizontal deflection magnetic field. Such a substantially uniform magnetic field can be created by adjusting the winding pattern of the horizontal deflection coil. Which is to say, the horizontal deflection magnetic field can be made substantially uniform by designing the horizontal deflection coil using a known technique. When the horizontal deflection magnetic field is substantially uniform, misconvergence in the horizontal direction occurs. However, this problem can be remedied using correction coils. In other words, the correction coils of the second embodiment serve to generate a magnetic lens for producing convergence in the horizontal direction, in addition to correcting upper and lower inner pincushion distortion.

An explanation on the magnetic lens generated by the correction coils is given later. First, the notion of a "substantially uniform magnetic field" is explained below.

The horizontal deflection magnetic field which is substantially uniform is the following.

Suppose the Z axis is the tube axis, the direction of the X axis is the horizontal direction of the phosphor screen, and the direction of the Y axis is the vertical direction of the phosphor screen, with the X coordinate and the Y coordinate on the Z axis both being 0. Let Bh(x,z) be the magnetic flux density of the Y axial direction component of the horizontal deflection magnetic field. Then Bh(x,z) can be expressed by Formula 1:

$$Bh(x,z)=Bh_0(z)+Bh_2(z)\cdot x^2 \quad \text{(Formula 1)}$$

where x is a variable showing the displacement in the direction of the X axis from the Z axis, and z is a variable showing the Z coordinate.

In Formula 1, $Bh_0(z)$ is the magnetic flux density of the Y axial direction component of the horizontal deflection magnetic field on the Z axis, and is a function of z. $Bh_2(z)$ is called a quadratic distortion coefficient, and is a function of z, too. $Bh_2(z)$ serves as the coefficient of $x^2$. If $Bh_2(z)=0$ regardless of the value of z, Bh(x,z) is determined by the value of z regardless of the value of x. When this is the case, the horizontal deflection magnetic field is a completely uniform magnetic field.

However, it is not easy to realize such a completely uniform magnetic field by coil design. Even if an attempt is made to realize a completely uniform magnetic field, in actuality $Bh_2(z)$ will end up having some component albeit only slightly. In this embodiment, therefore, if the horizontal deflection magnetic field satisfies Formula 2 at least in a range of 75% of the total dimension of the horizontal deflection coil in the direction of the Z axis, the horizontal deflection magnetic field is regarded as a substantially uniform magnetic field. Here, the maximum value of the magnetic flux density distribution $Bh_0(z)$ on the Z axis is set as 1, and x is expressed in mm.

$$|Bh_2(z)| \leqq 1\times10^{-4}(1/\mathrm{mm}^2) \quad \text{(Formula 2)}$$

Such a substantially uniform magnetic field has almost no distortions. Accordingly, the electron beams are not acted upon by the lens effect of the deflection magnetic field. As a result, the deformation of the electron beam spot shape can be suppressed, with it being possible to improve the resolution. In this embodiment, the three electron beams are in parallel with each other when entering the electron gun end of the substantial deflection magnetic field region (i.e. the electron gun end of the ferrite frame of the deflection yoke). That is to say, the three electron beams remain in parallel with each other until they enter the deflection magnetic field region, as no magnetic fields are present between the electron gun and the deflection magnetic field region.

Thus, the horizontal deflection magnetic field is designed as a substantially uniform magnetic field, and the three electron beams entering the deflection magnetic field region are arranged in parallel with each other. As a result, the three electron beams arriving at the phosphor screen do not have mutual deviations in the vertical direction, though they have mutual deviations in the horizontal direction. Therefore, if the horizontal deviations are adjusted, the three electron beams can be brought into convergence.

In this embodiment, the correction coils are used to converge the three electron beams in the horizontal direction.

In detail, the correction coils generate the magnetic lens (described later). The three electron beams are brought into convergence by this magnetic lens. The magnetic lens has a converging effect of causing the three electron beams to approach each other in the horizontal direction, regardless of which part of the phosphor screen the three electron beams reach. In detail, the three electron beams (B, G, and R) are fired from the electron gun in the direction of the tube axis, with predetermined intervals in the horizontal direction. This being so, the magnetic lens exerts an effect (converging effect) of moving the two outer electron beams (B and R) toward the central electron beam (G) in the horizontal direction so that the two outer electron beams meet the central electron beam on the phosphor screen.

Since the raster distortion correction effect of the correction coils has already been described in the first embodiment, its explanation has been omitted here, for simplicity's sake. Hence the description of the second embodiment focuses on the converging effect of the correction coils.

Figure 11:
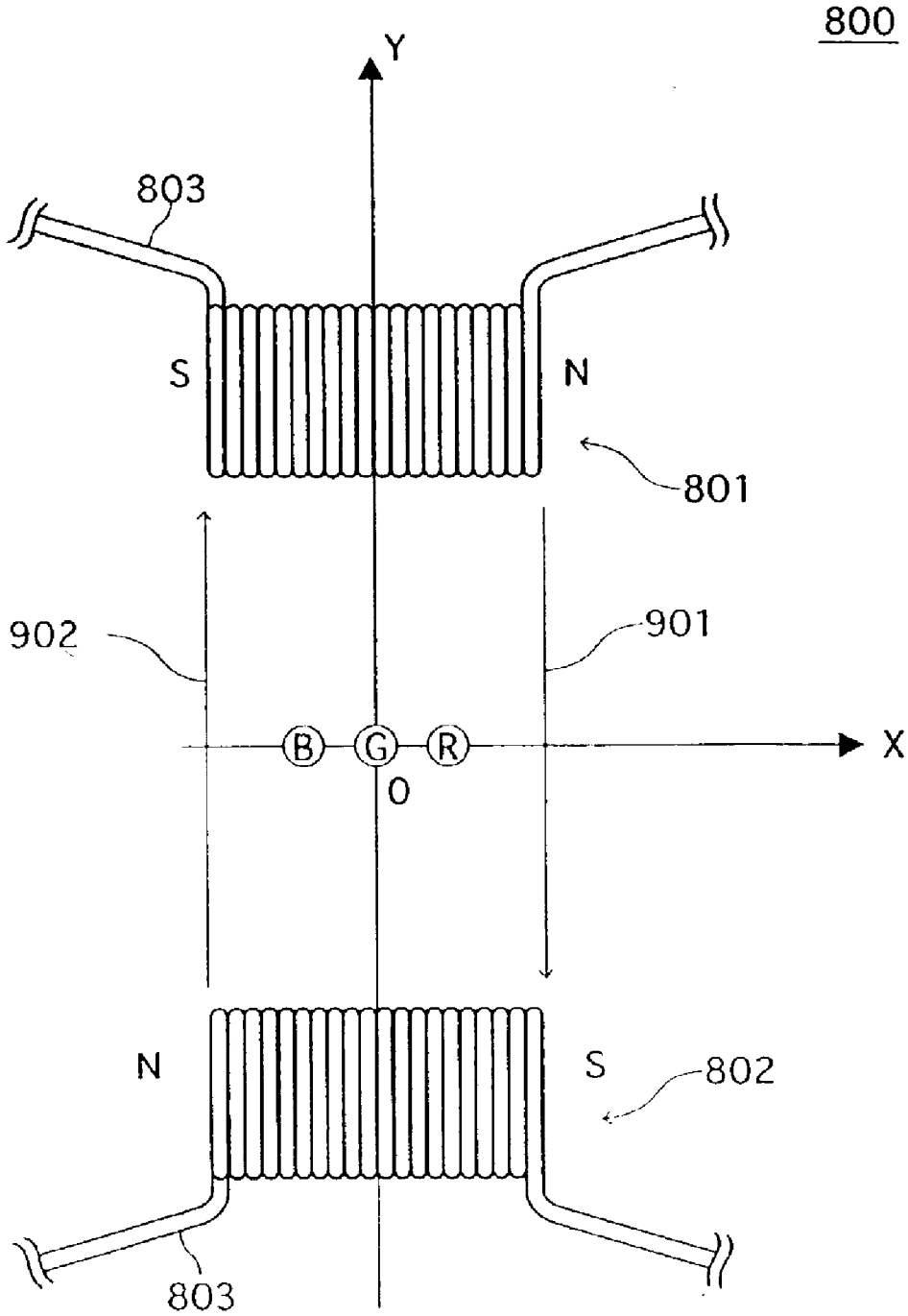
FIG. 11 is a representation of a construction and effect of a magnetic lens formed by a quadrupole coil according to the second embodiment of the invention.

FIG. 11 shows correction coils 801 and 802 in the second embodiment. In the drawing, the correction coils 801 and 802 and the three electron beams (R, G, B) passing therebetween are seen from the phosphor screen side.

Note here that the correction coils 801 and 802 are placed respectively in the same positions as the correction coils 661 and 662 in the first embodiment. Which is to say, the correction coils 801 and 802 generate magnetic fields that are closer than the electron gun end of the horizontal deflection magnetic field to the phosphor screen, as can be understood from FIG. 5 and the like. Accordingly, the three electron beams enter the horizontal deflection magnetic field without having been affected by other magnetic fields (i.e. the magnetic fields generated by the correction coils 801 and 802). The three electron beams are then acted upon by the magnetic fields generated by the correction coils 801 and 802, after they have been horizontally deflected or while they are being horizontally deflected.

The correction coils 801 and 802 generate the magnetic lens by four magnetic poles. Accordingly, the correction coils 801 and 802 are collectively called a "quadrupole coil 800".

The effect of the magnetic lens generated by the quadrupole coil 800 is explained in detail below, with reference to FIG. 11. In this embodiment, the correction coils 801 and 802 are each formed by winding a conducting wire 803 on a magnetic core (not illustrated) which is made of a Ni ferrite. A steady-state current is supplied to this conducting wire 803. Though the correction coils 801 and 802 each consist of 100 turns in this embodiment, the number of turns of each coil can be arbitrarily set.

According to this construction, the correction coils 801 and 802 function as magnet coils to form magnetic poles on both ends. As a result, a quadrupole magnetic field is generated as shown in FIG. 11. In more detail, a magnetic field 901 has a vertical component from the north pole of the correction coil 801 to the south pole of the correction coil 802. A magnetic field 902 has a vertical component from the north pole of the correction coil 802 to the south pole of the correction coil 801. These magnetic fields 901 and 902 exert a force in the horizontal direction on the electron beams.

Figure 12:
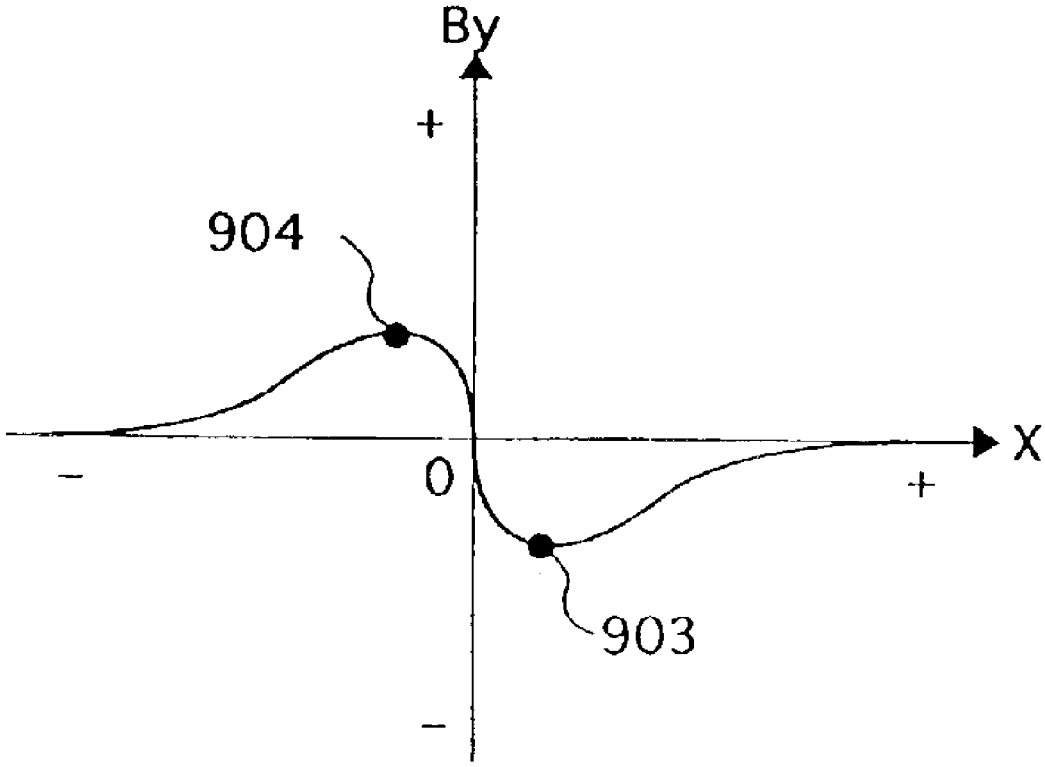
FIG. 12 shows an example of magnetic flux density distribution of the quadrupole magnetic field shown in FIG. 11, when electron beams are not vertically deflected.

The vertical component of the magnetic flux density of this quadrupole magnetic field has a magnetic flux density distribution in the horizontal direction as shown in FIG. 12. Here, "By" denotes the vertical component of the magnetic flux density of the quadrupole magnetic field, and "X" denotes the displacement in the horizontal direction from the tube axis. Peaks 903 and 904 of the absolute value of the magnetic flux density occur in the vicinity of the magnetic poles of the magnetic fields 901 and 902. In other words, the horizontal interval between the peaks 903 and 904 substantially coincides with the horizontal length of each of the correction coils 801 and 802. Also, the peak value of each of the peaks 903 and 904 is proportional to the amount of current supplied to each of the correction coils 801 and 802. In this embodiment, the horizontal length of each of the correction coils 801 and 802 is set such that the three electron beams always come between these two peaks 903 and 904 in the horizontal direction regardless of the amount of deflection.

The magnetic flux density distribution described above has the following effects. In the horizontal center of the phosphor screen where the three electron beams are not horizontally deflected by the horizontal deflection magnetic field (i.e. when the central electron beam (G) is at the center of the X axis as shown in FIG. 11), the central electron beam (G) passes the position of X=0 in FIG. 12 and so is not affected by the quadrupole magnetic field. Meanwhile, the two outer electron beams (B and R) are acted upon by a force of moving toward the central electron beam (G) by the vertical components of the quadrupole magnetic field that have opposite directions and similar intensities. As a result of this converging effect, the three electron beams are converged. Such a converging effect is exerted by the magnetic lens formed by the quadrupole magnetic field.

This concerns the case where the three electron beams reach the horizontal center of the phosphor screen. However, the three electron beams are also brought into convergence when they are horizontally deflected by the horizontal deflection magnetic field. In this case, the three electron beams are acted upon by the force in the horizontal direction with different strengths, as can be seen from FIG. 12. In FIG. 11, when the electron beams are deflected rightward, they are all acted upon by a leftward force. This leftward force decreases in the order of R, G, and B. As a result, the electron beams are converged. When the electron beams are deflected leftward, on the other hand, they are all acted upon by a rightward force. This rightward force decreases in the order of B, G, and R. As a result, the electron beams are converged. Such a difference in strength of a force acting upon the three electron beams agree with the inclination of the graph shown in FIG. 12. In other words, between the peaks 903 and 904 the difference is greatest in the horizontal center and decreases with the distance from the horizontal center.

Which is to say, the converging effect of the magnetic lens weakens from the horizontal center to periphery. In other words, the magnetic lens has an intensity distribution such that the converging effect becomes weaker as the distance from the horizontal center increases. When the three electron beams are deflected more in the horizontal direction, they pass through a part of the quadrupole magnetic field where the converging effect of the magnetic lens is weaker. Thus, the three electron beams are subjected to a weaker converging effect in the periphery than in the center in the horizontal direction.

It is well known that the distance traveled by the electron beams until they reach the phosphor screen is shortest in the center of the phosphor screen, and increases as the electron beams are more deflected to the periphery.

This being so, the above construction enables the three electron beams to be converged at a farther point (depending on the distance traveled by the electron beams) in the horizontal edges of the phosphor screen than in the center of the phosphor screen. Accordingly, proper convergence can be produced regardless of which part of the phosphor screen the electron beams reach.

This is achieved by the intensity distribution of the converging effect of the magnetic lens. Hence there is no need to vary the converging effect of the magnetic lens in sync with the horizontal deflection. Of course it is possible to vary the converging effect in sync with the horizontal deflection. However, this causes problems such as higher power consumption and greater circuit load, because the horizontal deflection frequency is high. According to this embodiment, on the other hand, convergence can be produced using a simple construction without having to vary the converging effect in sync with the horizontal deflection.

As described above, a simple construction having the following features enables the convergence to be produced and at the same time the resolution to be improved.

(a) A substantially uniform magnetic field is used as the horizontal deflection magnetic field.

(b) The three electron beams are in parallel with each other along the tube axis when entering the deflection magnetic field region.

(c) A magnetic lens that exerts a converging effect on the three electron beams is generated between the electron gun end of the deflection magnetic field region and the phosphor screen.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A color picture tube device comprising:

a funnel glass;

a pair of horizontal deflection coils which are opposed to each other in a vertical direction around an outer surface of the funnel glass, each horizontal deflection coil having a window at a center;

an insulating frame which (a) covers the pair of horizontal deflection coils, (b) resembles in shape a part of the funnel glass where the pair of horizontal deflection coils are provided, and (c) has openings in areas corresponding to windows of the pair of horizontal deflection coils;

a pair of vertical deflection coils which are opposed to each other in a horizontal direction around an outer surface of the insulating frame, without overlapping the openings; and a pair of correction coils which are each at least partially inserted in a different one of the openings.

2. The color picture tube device of claim 1, wherein the pair of correction coils each has a magnetic core.

3. The color picture tube device of claim 2, wherein the magnetic core is made up of a plurality of parts, one of which is a permanent magnet.

4. The color picture tube device of claim 1, wherein the pair of correction coils are each a solenoid coil, which is oriented so that two magnetic poles are arranged in the horizontal direction.

5. The color picture tube device of claim 4, wherein the pair of correction coils each has a magnetic core.

6. The color picture tube device of claim 5, wherein the magnetic core is made up of a plurality of parts, one of which is a permanent magnet.

7. The color picture tube device of claim 1, wherein a current that is synchronous with a vertical deflection current supplied to the pair of vertical deflection coils is supplied to the pair of correction coils.

8. The color picture tube device of claim 1, wherein a direct current is supplied to the pair of correction coils.

9. The color picture tube device of claim 1 further comprising:

a ferrite frame which is placed outside of the pair of vertical deflection coils, and has a pair of depressions on an inner surface, wherein the pair of correction coils are each partially inserted in a different one of the pair of depressions.

10. The color picture tube device of claim 9, wherein the ferrite frame also has a pair of portions cut away in a direction of a tube axis, and the pair of correction coils are also each partially inserted in a different one of spaces created by the cutaway.

11. In a color picture tube device having a sealed tube with an electron gun providing a scan of a phosphor screen, the improvement comprising:

a pair of horizontal deflection coils spaced in a vertical direction about an exterior of the sealed tube;

an insulting frame extending over the pair of horizontal deflection coils in a configuration complementary to the exterior surface of a portion of the sealed tube with two spaced apart openings in areas that are apart from the horizontal deflection coils;

a pair of vertical deflection coils spaced in a horizontal direction on an outer surface of the insulating frame without overlapping the spaced apart openings; and a pair of correction coil units, one each supported relative to the insulating frame to at least partially extend into a corresponding opening in the insulating frame, to correct distortions in the scan of the phosphor screen.

12. The color picture tube device of claim 11 further including a ferrite frame extending about an exterior portion of the vertical deflection coils with a pair of depressions on an inner surface positioned complimentarily to the spaced apart openings, each of the respective correction coil units is mounted to extend within a corresponding aligned spaced apart opening.

13. The color picture tube device of claim 11 wherein each of the correction coil units includes a core member wrapped with a conductor winding, the core member includes a magnetically conducting member and a permanent magnet.

14. The color picture tube device of claim 13 wherein the magnetically conducting member is larger in volume than the permanent magnet.

15. The color picture tube device of claim 11 wherein the spaced apart openings extend through the insulating frame.

* * * * *